US011480892B2

(12) United States Patent
Iwata

(10) Patent No.: US 11,480,892 B2
(45) Date of Patent: Oct. 25, 2022

(54) DEVELOPING DEVICE TO FORM ELECTROSTATIC LATENT IMAGES

(71) Applicant: Hewlett-Packard Development Company, L.P., Spring, TX (US)

(72) Inventor: Naoya Iwata, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/282,483

(22) PCT Filed: Sep. 24, 2019

(86) PCT No.: PCT/US2019/052565

§ 371 (c)(1),
(2) Date: Apr. 2, 2021

(87) PCT Pub. No.: WO2020/076498

PCT Pub. Date: Apr. 16, 2020

(65) Prior Publication Data

US 2021/0356885 A1 Nov. 18, 2021

(30) Foreign Application Priority Data

Oct. 12, 2018 (JP) ..... JP2018-193182

(51) Int. Cl.
*G03G 15/08* (2006.01)
*G03G 15/09* (2006.01)

(52) U.S. Cl.
CPC ..... *G03G 15/0891* (2013.01); *G03G 15/0844* (2013.01); *G03G 15/0889* (2013.01);
(Continued)

(58) Field of Classification Search
CPC ..... G03G 15/0891; G03G 15/0889; G03G 2215/085; G03G 15/0893; G03G 15/00;
(Continued)

(56) References Cited

U.S. PATENT DOCUMENTS 8,655,237 B2 2/2014 Suzuki et al.
2003/0143001 A1 7/2003 Mitsuya et al.
(Continued)

FOREIGN PATENT DOCUMENTS

CN 103853012 B 10/2017
EP 2 341 400 B1 9/2018
(Continued)

*Primary Examiner* — Walter L Lindsay, Jr.
*Assistant Examiner* — Laura Roth
(74) *Attorney, Agent, or Firm* — Jefferson IP Law, LLP

(57) ABSTRACT

An example device to develop an electrostatic latent includes first and second passages coupled to each other through first and second openings. A first stir-and-transport member located in the first passage includes a first helical blade to stir and transport a developer along the first passage in a first direction and to supply the developer to a developing roller. A second stir-and-transport member located in the second passage includes a second helical blade to stir and transport the developer along the second passage in a second direction. A developer discharge pipe is coupled to the developer container to communicate with a downstream side of the first passage. The first stir-and-transport member includes a first reverse helical blade having a pitch between approximately 0.5 times and 1.5 times the pitch of the first helical blade and located downstream of the first helical blade and disposed downstream of the second opening.

15 Claims, 8 Drawing Sheets

(52) U.S. Cl.
CPC ... *G03G 15/0942* (2013.01); *G03G 2215/085* (2013.01); *G03G 2215/0838* (2013.01)

(58) Field of Classification Search
CPC ..... G03G 15/08; G03G 2215/0838; G03G 15/0942; G03G 15/0844
See application file for complete search history.

(56) References Cited

U.S. PATENT DOCUMENTS

| | | | | |
|---|---|---|---|---|
| 2006/0239720 | A1* | 10/2006 | Hirota | G03G 15/0877 399/258 |
| 2011/0229209 | A1* | 9/2011 | Takaya | G03G 15/0893 399/257 |
| 2014/0314451 | A1 | 10/2014 | Hosokawa et al. | |
| 2015/0132027 | A1* | 5/2015 | Kashimoto | G03G 15/0877 399/254 |
| 2015/0277294 | A1* | 10/2015 | Kurihara | G03G 15/0893 399/254 |
| 2017/0248868 | A1* | 8/2017 | Iwata | G03G 15/0893 |
| 2018/0335722 | A1* | 11/2018 | Ariizumi | G03G 15/0893 |

FOREIGN PATENT DOCUMENTS

| | | | |
|---|---|---|---|
| JP | 2008-122428 | A | 5/2008 |
| JP | 2011-53626 | A | 3/2011 |
| JP | 2014-115548 | A | 6/2014 |
| KR | 10-1622288 | B1 | 5/2016 |

* cited by examiner

DEVELOPING DEVICE TO FORM ELECTROSTATIC LATENT IMAGES

BACKGROUND

Image forming systems may include developing devices that develop electrostatic latent images formed on photosensitive drums with toner.

Among developing devices that use two-component developers composed of toner and carrier, some may have an automatic developer replenishment mechanism, e.g., an Auto Developer Refill (ADR) mechanism, that automatically replenishes a developer to a container. During replenishment of the developer, excessive developer that has flown into a discharge pipe beyond a reverse helical blade disposed in the vicinity of an inlet to the discharge pipe is discharged from the container.

DETAILED DESCRIPTION

Figure 1:
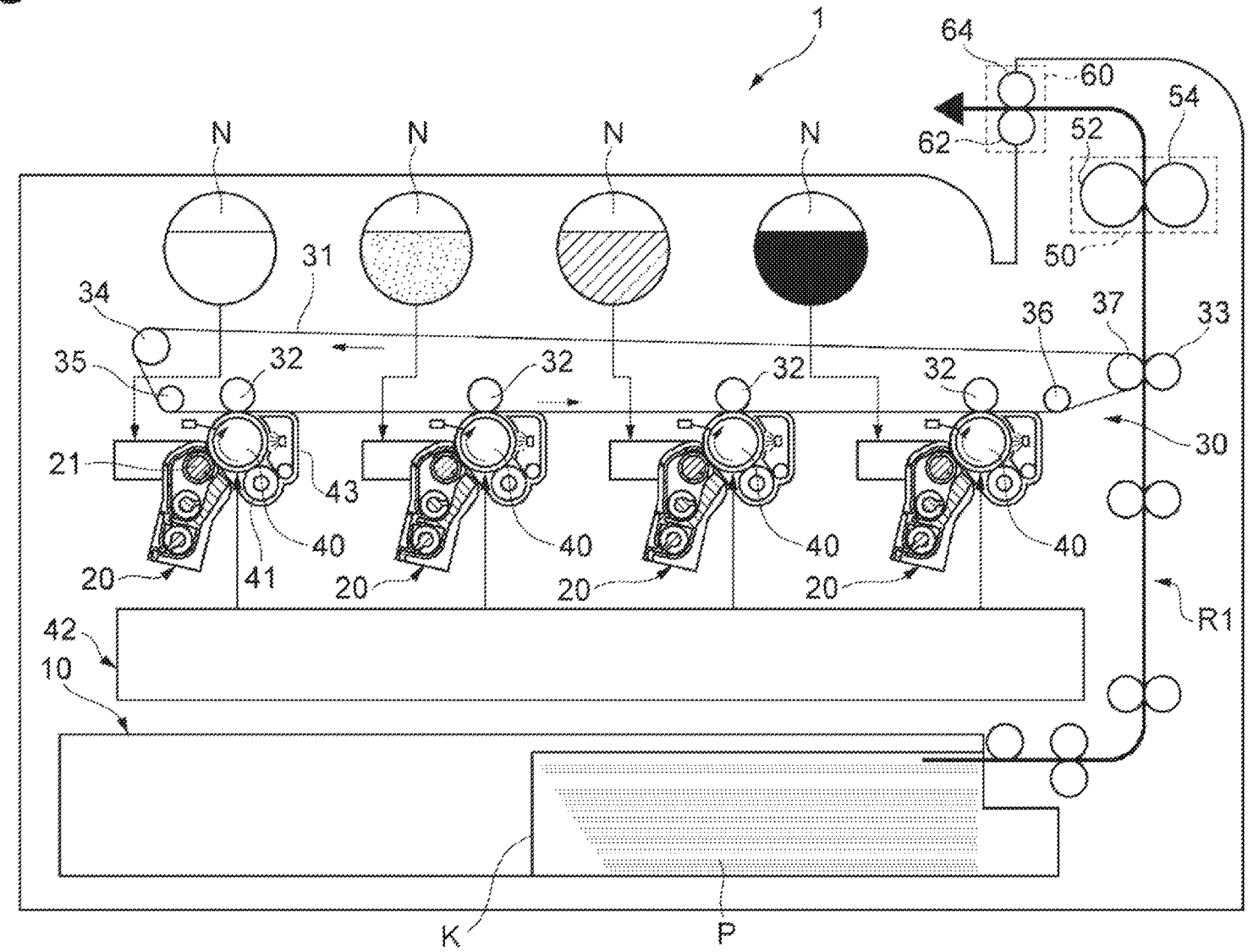
FIG. 1 is a schematic cross sectional view illustrating an example imaging apparatus.

A developing device may include an ADR mechanism. In some examples, during operation of the developing device, the rotation of a developing roller may entrain air into the interior of a developer container and the inner pressure of the container is increased thereby. The increase in the inner pressure may generate an airflow directed from the container to a discharge pipe beyond a reverse helical blade and may cause discharge of airborne developer from the container, and the developer in the container may thereby be excessively reduced.

In some examples, a device to develop an electrostatic latent image in an imaging apparatus may comprise a developer container including first and second passages coupled to or in communication with each other through first and second openings to form a circulation passage. Additionally, the device may comprise a first stir-and-transport member disposed in the first passage and including a first helical blade to stir and transport a developer from the first opening to the second opening along the first passage in a first direction and to supply the developer to a developing roller, a second stir-and-transport member disposed in the second passage and including a second helical blade to stir and transport the developer from the second opening to the first opening along the second passage in a second direction, and a developer discharge pipe coupled to the developer container to communicate with a downstream side of the first passage. The first stir-and-transport member may include a first reverse helical blade formed or otherwise located downstream of the first helical blade and disposed downstream of the second opening. The pitch of the first reverse helical blade may be between approximately 0.5 times and 1.5 times the pitch of the first helical blade. The pitch of the first reverse helical blade may be between approximately 0.5 times and 1.5 times the pitch of the first helical blade at an end facing the first reverse helical blade.

The first reverse helical blade may comprise two or more reverse helical blades. In other examples, the first reverse helical blade may comprise one reverse helical blade. The device may include a magnet disposed on an inner wall of the first passage opposing the first reverse helical blade. The magnet may be a one-sided multipole magnetized magnet. The magnet may have N and S poles alternately arranged along a longitudinal direction of the first stir-and-transport member.

The pitch of the first helical blade at an end facing the first reverse helical blade may be narrower than the pitch of the remaining portion of the first helical blade, and the pitch of the first reverse helical blade may be between approximately 0.5 times and 1.5 times the pitch of the first helical blade at an end facing the first reverse helical blade.

The developer discharge pipe may have a developer outlet spaced from an end of the developer discharge pipe, and the first stir-and-transport member may include a third helical blade formed or otherwise located adjacent to the first reverse helical blade on the opposite side of the first helical blade. The third helical blade may be disposed in the developer discharge pipe to transport the developer that has flown from the first passage into the developer discharge pipe toward the developer outlet. Additionally, the first stir-and-transport member may include a second reverse helical blade formed or otherwise located adjacent to a downstream side of the third helical blade and disposed downstream of the developer outlet.

The developer container may include a filter to provide a means for pressurized air to escape from the developer container to the outside. The device may include a developer replenishment pipe coupled to the developer container to communicate with an upstream side of the second passage. The device may include a developer replenishment pipe coupled to the developer container to communicate with an upstream side of the second passage.

An example imaging apparatus may include any of the aforementioned various devices.

In some examples, a method of manufacturing a developing device may comprise forming a developer container that includes first and second passages couple to or otherwise configured to communicate with each other through first and second openings to form a circulation passage. Additionally, the first passage may be disposed in a first stir-and-transport member that includes a first helical blade to stir and transport a developer from the first opening to the second opening along the first passage in a first direction and to supply the developer to a developing roller. The method may further comprise disposing in the second passage a second stir-and-transport member that includes a second helical blade to stir and transport the developer from the second opening to the first opening along the second passage in a second direction, and coupling a developer discharge pipe to the developer container to communicate with a downstream side of the first passage. The first stir-and-transport member may include a first reverse helical blade formed or otherwise located downstream of the first helical blade and disposed downstream of the second opening. The pitch of the first reverse helical blade may be between approximately 0.5 times and 1.5 times the pitch of the first helical blade. The pitch of the first reverse helical blade may be between approximately 0.5 times and 1.5 times the pitch of the first helical blade at an end facing the first reverse helical blade.

The first reverse helical blade may comprise two or more reverse helical blades. In other examples, the first reverse helical blade may comprise one reverse helical blade. The manufacturing method may include disposing a magnet on an inner wall of the first passage opposing the first reverse helical blade. The magnet may be a one-sided multipole magnetized magnet.

In some examples, the pitch of the first helical blade at an end facing the first reverse helical blade may be narrower than the pitch of the remaining portion of the first helical blade, and the pitch of the first reverse helical blade may be between approximately 0.5 times and 1.5 times the pitch of the first helical blade at an end facing the first reverse helical blade.

The manufacturing method may include disposing a filter in the developer container through which pressurized air may escapes from the developer container to the outside.

In the following description, with reference to the drawings, the same reference numbers are assigned to the same components or to similar components having the same function, and overlapping description is omitted.

FIG. 1 illustrates an example imaging apparatus 1. The imaging apparatus 1 may be a printer, a component of an imaging system, or an imaging system. For example, the imaging apparatus 1 may comprise a developing device used in an imaging system or the like. Additionally, the imaging apparatus 1 may include, for each of four toner colors (magenta, yellow, cyan and block), a toner bottle N, a developing device 20, a photosensitive drum 40, a charge roller 41, and a cleaning unit 43. The imaging apparatus 1 may also include a recording medium transport unit 10, a transfer device 30, an exposure unit 42, a fixing device 50, and a discharge device 60. The transfer device 30 includes an intermediate transfer belt 31, support rollers 34, 35, 36 and 37 for supporting the intermediate transfer belt 31 to provide a means for a circulating movement, four primary transfer rollers 32 respectively corresponding to the four photosensitive drums 40, and a secondary transfer roller 33 that is rotatable to follow the movement of the intermediate transfer belt 31 while pressing a sheet of paper P onto the intermediate transfer belt 31. The support roller 37 may comprise a drive roller for circularly moving the intermediate transfer belt 31 in a direction indicated by the arrows.

The imaging apparatus 1 may be configured to charge each of the photosensitive drums 40 by the corresponding charge roller 41, and to form thereon an electrostatic latent image by the exposure unit 42 according to image data for the corresponding color. In some examples, the imaging apparatus 1 develops by the corresponding developing device 20 the electrostatic latent image with a toner from the corresponding toner bottle N to form a toner image. The four color images respectively formed on the four photosensitive drums 40 are then successively overlaid or superimposed on the intermediate transfer belt 31 by the primary transfer rollers 32 to form a composite toner image. The toner image superimposed on the intermediate transfer belt 31 is then transferred onto the sheet of paper P by the secondary transfer roller 33, and fused or otherwise fixed onto the sheet of paper P by the fixing device 50 including a heater roller 51 and a pressure roller 52. The sheet of paper P is transported one by one by the recording medium transport unit 10 from a cassette K along a transport path R1, and discharged from the discharge device 60 including discharge rollers 62, 64 after receiving transfer of the toner image by the secondary transfer roller 33.

The example developing device 20 may comprise a device for developing electrostatic latent images in the image forming apparatus 1 or in other imaging apparatuses.

Figure 2:
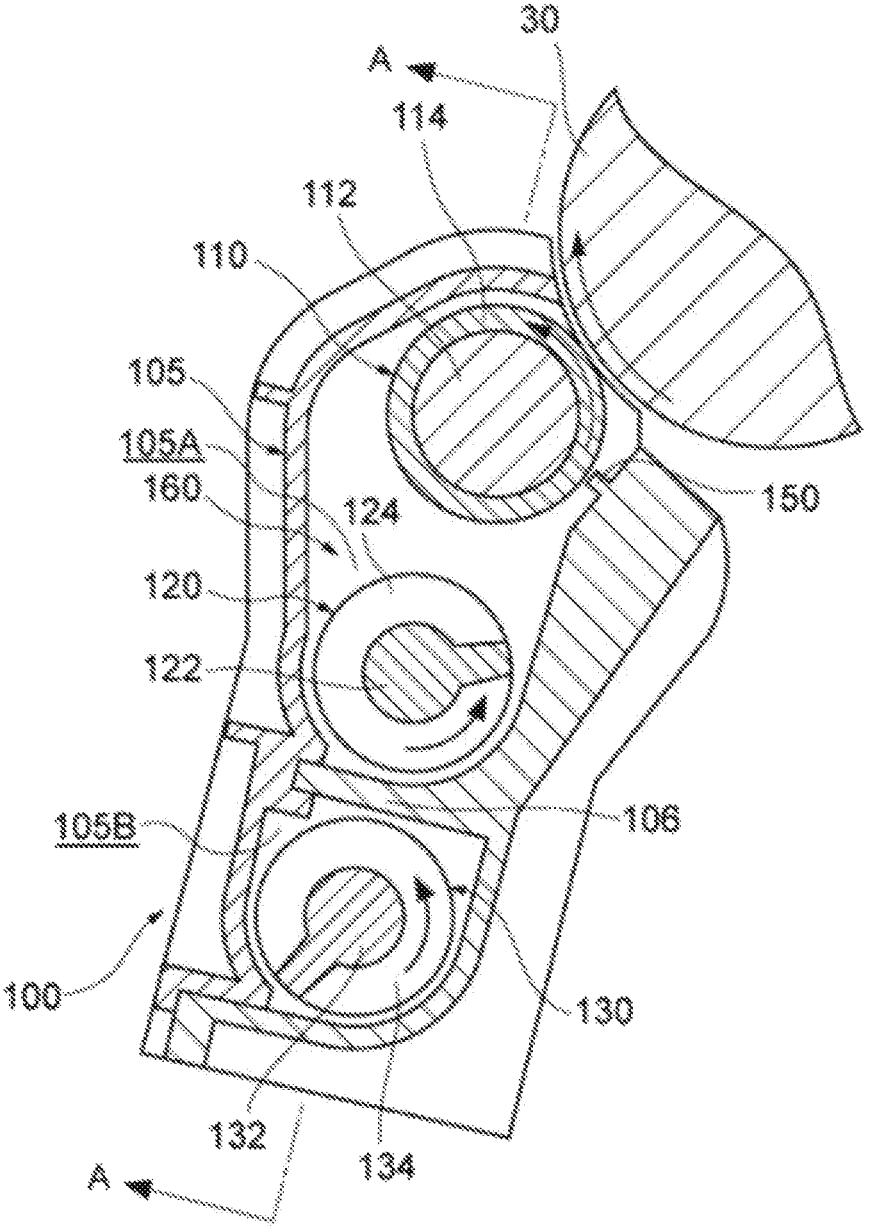
FIG. 2 is a schematic cross sectional view illustrating an example device for developing electrostatic latent images in an imaging apparatus.
Figure 3:
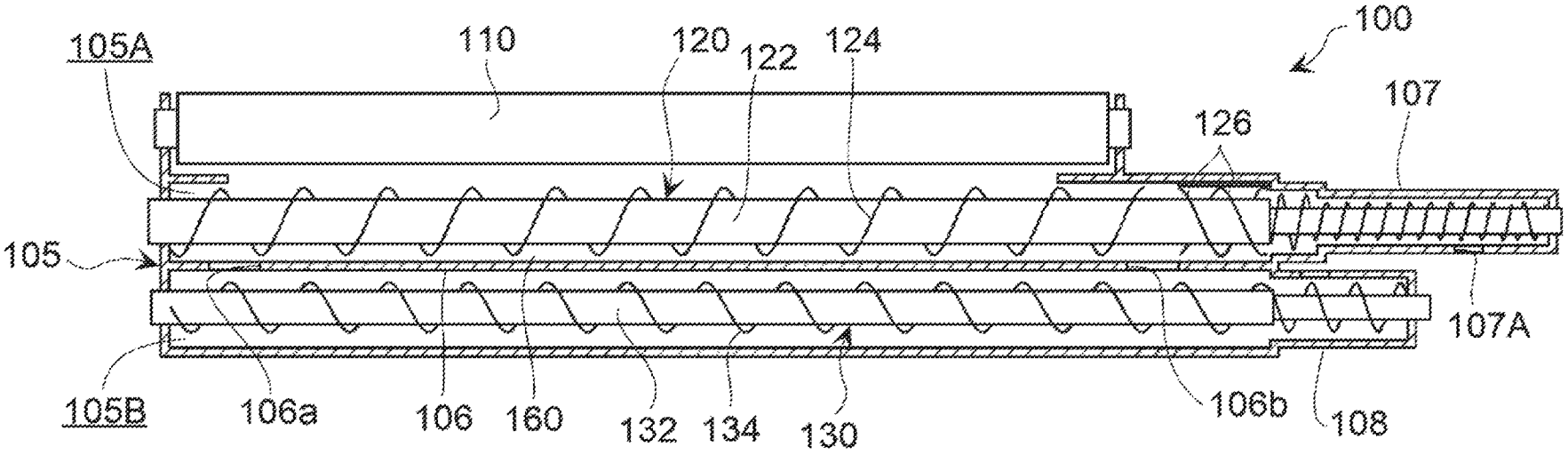
FIG. 3 is a schematic cross sectional view along A-A line in the device of FIG. 2.

FIG. 2 is a schematic cross sectional view illustrating an example device 100 for developing electrostatic latent images in an imaging apparatus. FIG. 3 is a schematic cross sectional view along A-A line in the device 100 of FIG. 2. With reference to FIG. 2 and FIG. 3, the device 100 comprises a developer container 105 including a first passage 105A and a second passage 105B coupled to or in communication with each other through a first opening 106*a* and a second opening 106*b* to form a circulation passage. Additionally, the device 100 may comprise a first stir-and-transport member 120 disposed in the first passage 105A and including a first helical blade 124 to stir and transport a developer from the first opening 106*a* to the second opening 106*b* along the first passage 105A in a first direction and to supply the developer to a developing roller 110, and a second stir-and-transport member 130 disposed in the second passage 1056 and including a second helical blade 134 to stir and transport the developer from the second opening 106*b* to the first opening 106*a* along the second passage 105B in a second direction. A developer discharge pipe 107 may be coupled to the developer container 105 to communicate with a downstream side of the first passage 105A. The device 100 may further include a developer replenishment pipe 108 coupled to the developer container 105 to communicate with an upstream side of the second passage 1056.

The first passage 105A and the second passage 1056 are disposed adjacent and parallel to each other, and the first opening 106*a* and the second opening 106*b* are formed or otherwise located in a partition wall 106 between the first passage 105A and the second passage 105B. In some examples, the first passage 105A and the second passage 1056 may be non-parallel to each other, and the first passage 105A and the second passage 105B may be spatially separated from (not adjacent to) each other.

The first stir-and-transport member 120 includes a support shaft 122 and a first helical blade 124 formed or otherwise located around the support shaft 122. The second stir-and-transport member 130 includes a support shaft 132 and a second helical blade 134 formed or otherwise located around the support shaft 132. The second helical blade 134 may have a spiral direction opposite to that of the first helical blade 124 so that the direction of transporting the developer is reversed between the first passage 105A and the second passage 105B, and the support shaft 132 is rotated in the same direction as the support shaft 122. In some examples, the second helical blade 134 has the same spiral direction as the first helical blade 124, and the support shaft 132 may be rotated in the opposite direction from the support shaft 122. The first helical blade 124 and the second helical blade 134 stir the developer composed of a magnetic carrier and a non-magnetic toner, and charge the carrier and toner by friction.

The developing roller 110 includes a cylindrical magnet 112 fixedly disposed within the developer container 105, and a developing sleeve 114 made of a non-magnetic metal rotatably disposed around the magnet 112. A gap may be provided between the magnet 112 and the developing sleeve 114. The developing roller 110 is disposed in the developer container 105 to oppose the first helical blade 124 of the first stir-and-transport member 120 in such a manner that part of the outer circumferential surface thereof is exposed outside the developer container 105. During operation of the device 100, the developing sleeve 114 is rotated and absorbs the developer stirred by the first helical blade 124 and charged in the first passage 105A by the magnetic force, so that the developer can make contact with an electrostatic latent image on the photosensitive drum 30. A layer regulating member 150 such as a metal blade may be mounted opposite the outer circumferential surface of the developing roller 110 in the developer container 105, so as to form a layer of the developer at a uniform thickness over the outer circumferential surface of the developing sleeve 114.

The first stir-and-transport member 120 further includes a first reverse helical blade 126 formed or otherwise located downstream of the first helical blade 124 and disposed downstream of the second opening 106*b*, so as to prevent the developer from being discharged from the developer container 105 through the developer discharge pipe 107 during operation of the device 100. The reverse helical blade 126 functions to push back the developer directed from the first passage 105A to the developer discharge pipe 107 during operation of the device 100.

Figure 4:
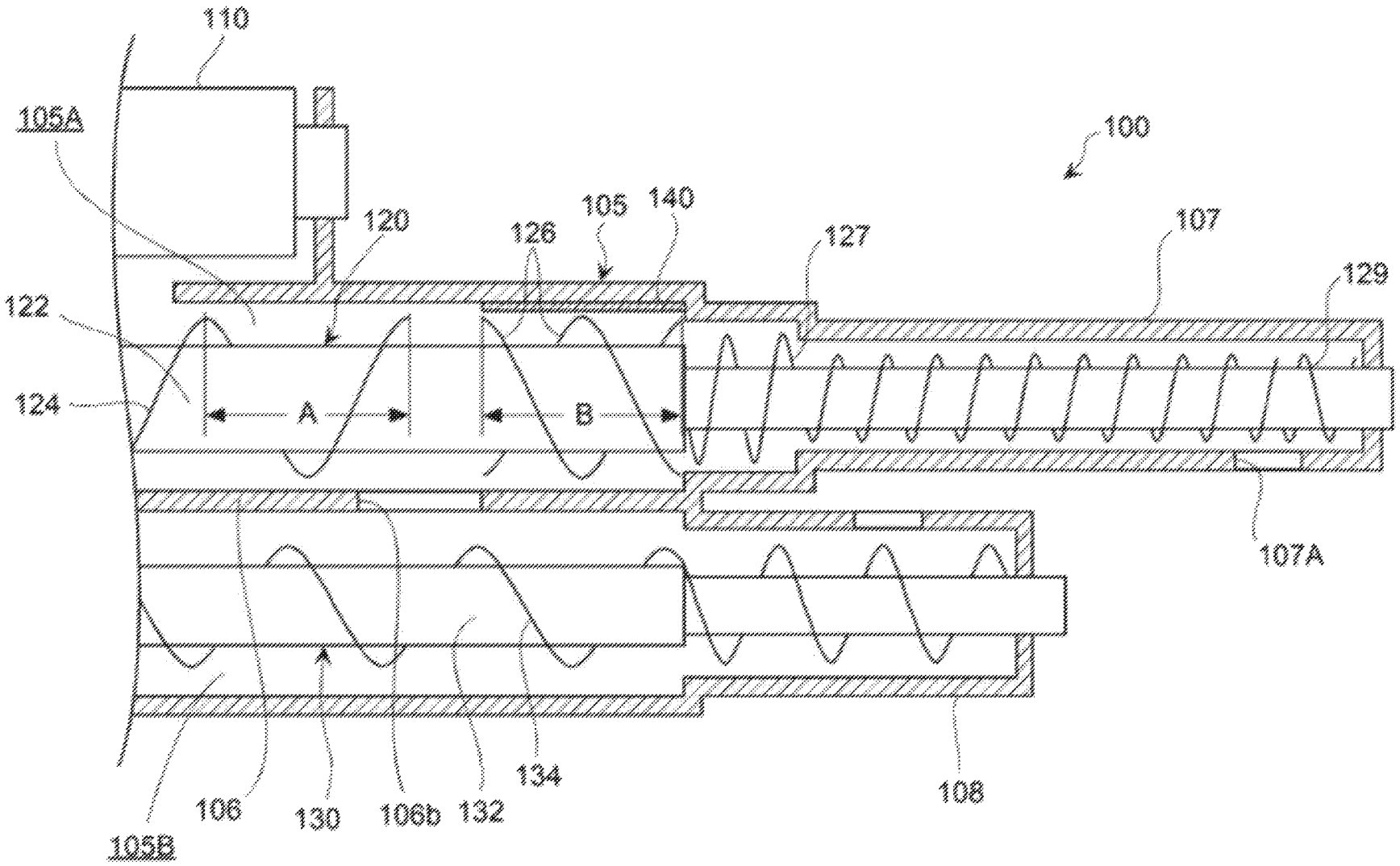
FIG. 4 is an enlarged schematic cross sectional view near an example developer discharge pipe in the device of FIG. 3.

FIG. 4 is an enlarged schematic cross sectional view near the developer discharge pipe 107 in the device 100 of FIG. 3. During operation of the developing device 100, the rotation of the developing roller 110 may entrain air into the interior of the developer container 105 and the inner pressure of the container is increased thereby. The increase in the inner pressure may generate an airflow directed from the first passage 105A to the developer discharge pipe 107 in a gap between the first reverse helical blade 126 and the inner wall of the first passage 105A, and airborne developer within the container can be carried by the airstream and discharged.

In the illustrated example, the first reverse helical blade 126 is provided to prevent the discharge of some or all of the airborne developer. In some examples, the first reverse helical blade 126 comprises two helical blades, and has a pitch B that is between approximately 0.5 times and 1.5 times a pitch A of the first helical blade 124 at an end facing the first reverse helical blade 126. The pitch of the first helical blade 124 may or may not be uniform along the longitudinal direction of the first stir-and-transport member 120. In some examples, the "pitch" of a helical blade or a reverse helical blade may be understood to denote the distance between adjacent spirals in the direction of axis of rotation and, when it comes to multiple helical blades, to denote the distance between adjacent spirals of particular one of the helical blades in the direction of axis of rotation. With the pitch B falling in the above range of 0.5 times to 1.5 times the pitch A, the first reverse helical blade 126 both pushes back the developer directed from the first passage 105A to the developer discharge pipe 107 and functions to generate an airflow directed from the developer discharge pipe 107 to the first passage 105A in the gap between the first reverse helical blade 126 and the inner wall of the first passage 105A.

The first helical blade 126 may comprise two or more reverse helical blades (i.e., multiple reverse helical blades). However, in other examples, the first reverse helical blade 126 may comprise one reverse helical blade.

Figure 5:
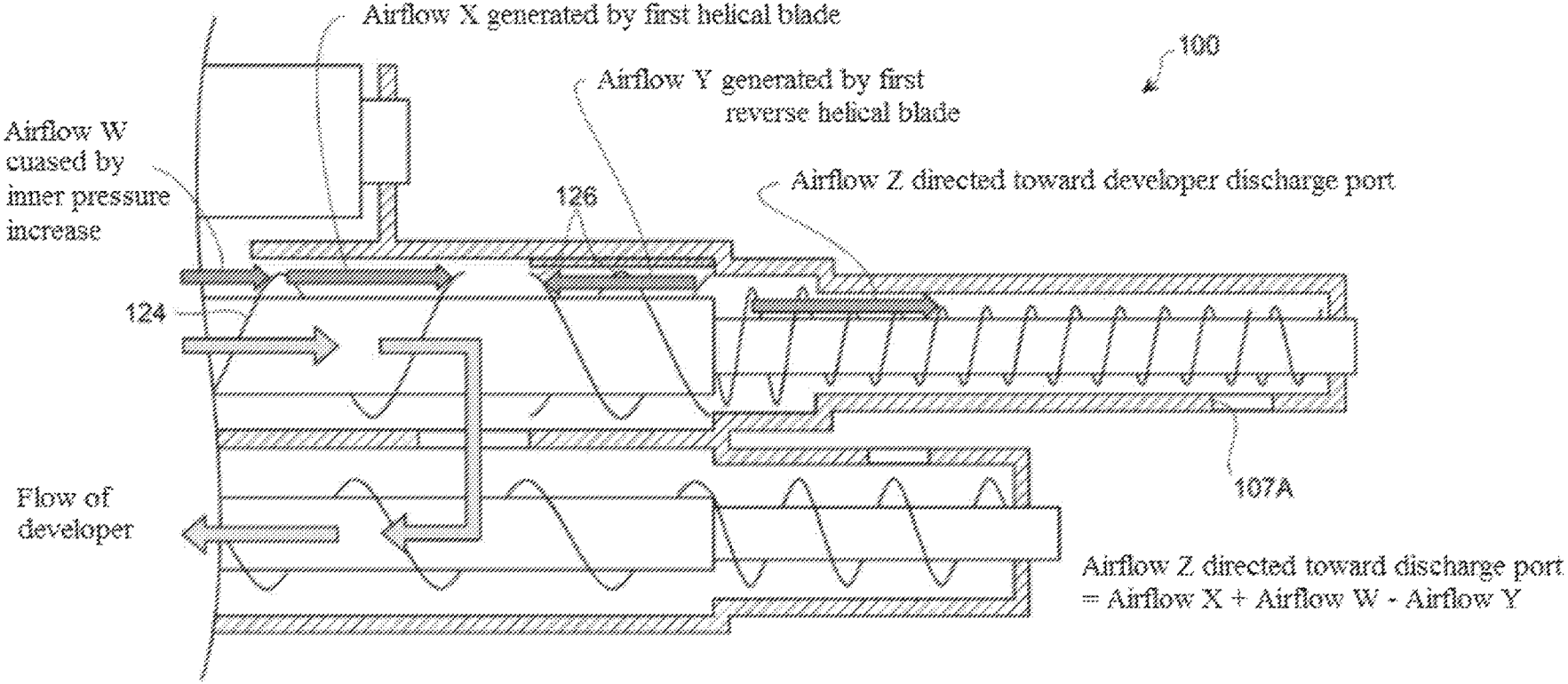
FIG. 5 is a diagram illustrating airflows and developer flows in the devices of FIG. 1 to FIG. 4.

FIG. 5 illustrates airflows and developer flows in the device 100. An airflow Y generated by the first reverse helical blade 126 cancels with an airflow X generated by the first helical blade 124, as well as part of an airflow W generated by pressure increase in the developer container 105, and thereby lowers the speed of an airflow Z directed toward the developer discharge pipe 107. As a result, the discharge of airborne developer from the developer container 105 can be reduced.

Figure 6:
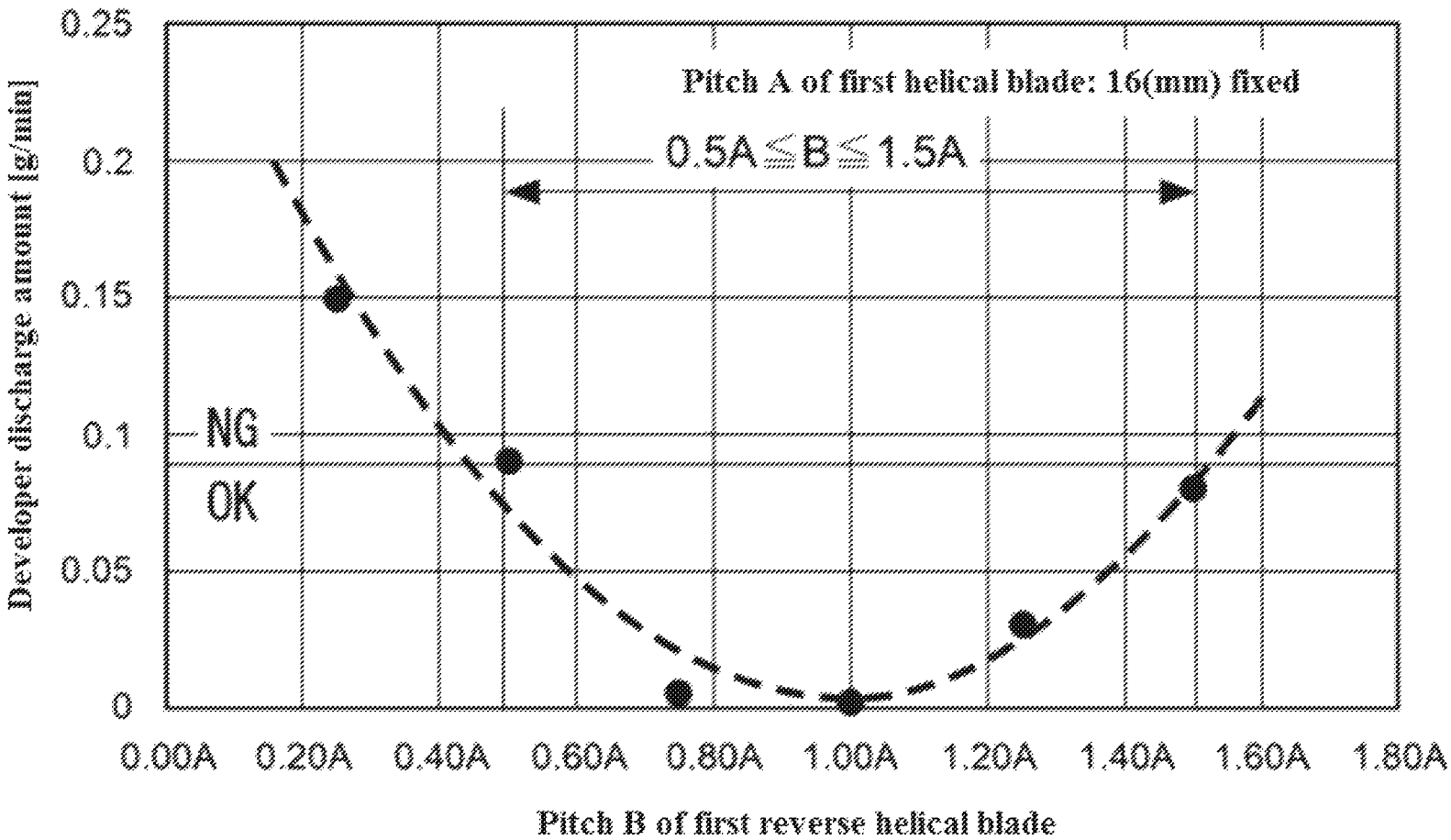
FIG. 6 is a graph illustrating an example relationship between a pitch of a first reverse helical blade and a discharge amount of developer.

FIG. 6 is a graph illustrating a relationship between the pitch B [mm] of the first reverse helical blade 126 and a discharge amount of developer [g/min], in an example in which the pitch A of the first helical blade 124 is 16 mm (constant). The first reverse helical blade 126 is illustrated as including two helical blades. As shown in the graph of FIG. 6, the ability of the first reverse blade 126 to block airborne developer is lowered when the pitch B is too wide, and the ability of the first reverse blade 126 to generate airflow is lowered when the pitch B is too narrow. Further, when an upper limit of the discharge amount of developer is 0.09 g [g/min], it can be understood from the graph that an example range of the pitch B of the first reverse helical blade 126 is between approximately 0.5 times and 1.5 times the pitch A.

Referring back to the description of FIG. 4, the device 100 may further include a magnet 140 disposed on an inner wall of the first passage 105A and facing the first reverse helical blade 126. The magnet 140 absorbs by the magnetic force airborne developer from the airflow directed toward the developer discharge pipe 107 through the gap between the first reverse helical blade 126 and the inner wall of the first passage 105A, thereby to further reduce discharge of airborne developer. The magnet 140 may comprise a rubber magnet, and may be attached to the inner wall of the passage 105A with a double-sided adhesive tape, adhesive, or the like. The magnet 140 may be disposed over a range of 50% or more of the inner periphery of the first passage 105A, in a gravitationally upper side of the inner periphery. In a gravitationally lower side of the inner periphery of the first passage 105A, the device 100 may have a region over 30% or more of the inner periphery where the magnet 140 is not disposed. The magnet 140 may comprise a one-sided multipole magnetized magnet, so as to prevent magnetic field leaking outside the device 100. The magnet 140 may have N and S poles alternately arranged along a longitudinal direction of the first stir-and-transport member 120 to absorb the developer.

The developer discharge pipe 107 may have a developer outlet 107A spaced from an end of the developer discharge pipe 107, and the first stir-and-transport member 120 may include a third helical blade 127 formed or otherwise located adjacent to the first reverse helical blade 126 on the opposite side of the first helical blade 124. The third helical blade 127 may be disposed in the developer discharge pipe 107 to transport the developer that has flown from the first passage 105A into the developer discharge pipe 107 toward the developer outlet 107A. Additionally, the first stir-and-transport member 120 may include a second reverse helical blade 129 formed or otherwise located adjacent to a downstream side of the third helical blade 127 and disposed downstream of the developer outlet 107A. The second reverse helical blade 129 may be configured to cover part of the developer outlet 107A in the longitudinal direction of the developer discharge pipe 107. The second reverse helical blade 129 may prevent the developer from entering into bearings supporting the first stir-and-transport member 120 and decelerate the speed of the airflow entering into the developer discharge port 107A, thereby to further reduce the discharge of airborne developer. While the inner diameter of the developer discharge pipe 107 may be reduced in the direction of the developer outlet 107A for further reducing the speed of airflow directed toward the developer discharge port 107A, in other examples the developer discharge pipe 107 may have a uniform inner diameter along the longitudinal direction. Further, while the outer diameter of the third helical blade 127 may be reduced to follow the change in the inner diameter of the developer discharge pipe 107, in other examples the outer diameter of the third helical blade 127 may be kept uniform.

The developer container 105 may further include a filter to provide a means for pressurized air to escape from the developer container 105 to the outside. In some examples, the developer container 105 may further include a vent port to the outside of the container 105, and the filter may be disposed in the vent port.

Figure 7:
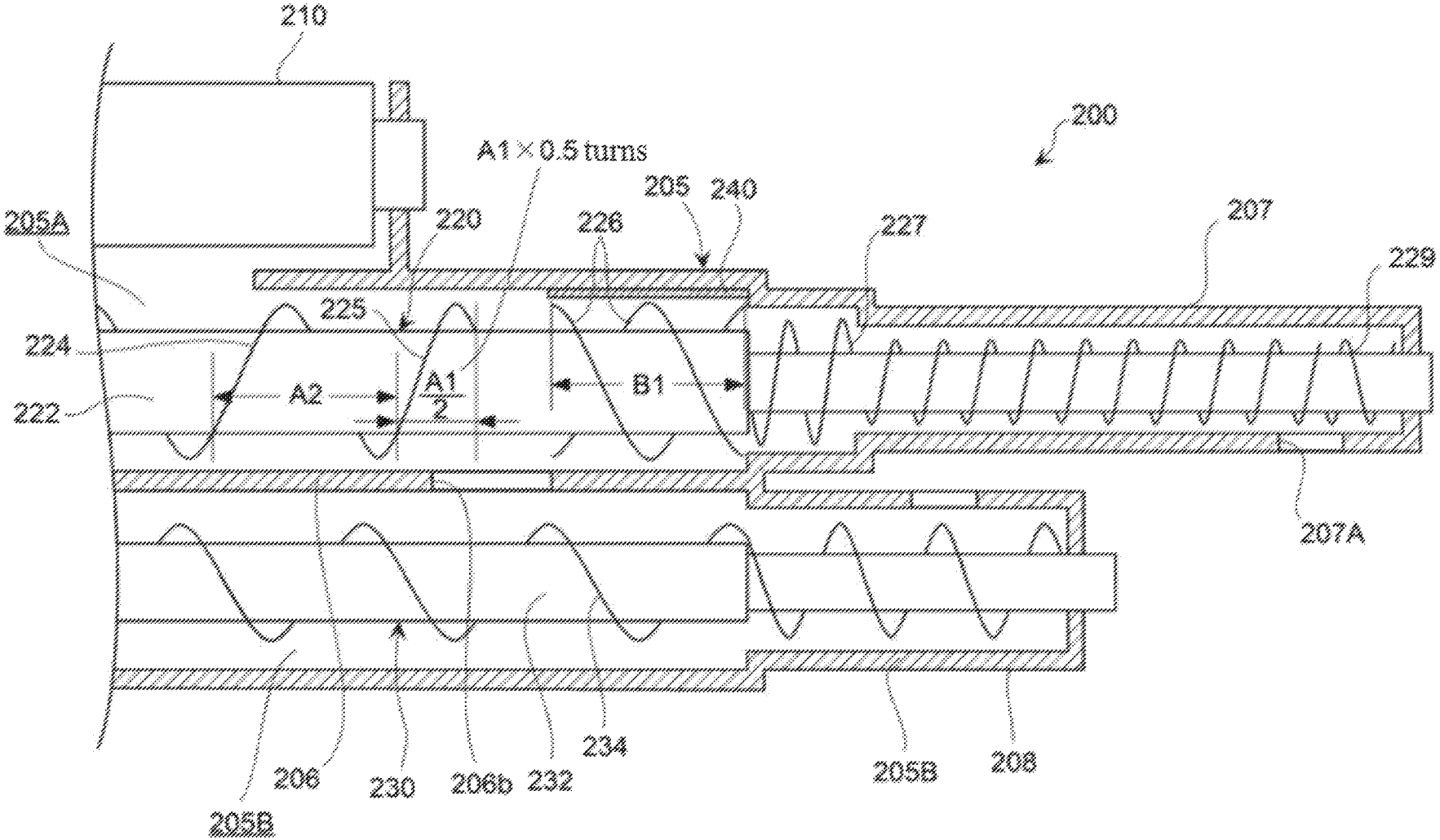
FIG. 7 is a schematic cross sectional view near a developer discharge pipe in another example device.

FIG. 7 illustrates another example device 200. The device 200 may be constructed in the same manner as the device 100, except that a pitch A1 of the first helical blade 224 at an end 225 facing the first reverse helical blade 226 is narrower than a pitch A2 of the remaining portion of the first helical blade 224 and a pitch B1 of the first reverse helical blade 226 is between approximately 0.5 times and 1.5 times the pitch A1 of the first helical blade 224 at the end 225 facing the first reverse helical blade 226. For elements of the device 200 that are common to elements of the device 100, overlapping descriptions will be omitted by assigning in FIG. 7 the reference numerals of the corresponding elements of the device 100 incremented by 100. When the pitch A1 of the first helical blade 224 at the end 225 facing the first reverse helical blade 226 is made narrower in this manner than the pitch A2 of the remaining portion of the first helical blade 224, stirring up of the developer at the end 225 of the first helical blade 224 can be prevented, and the generation of airborne developer may be reduced. Further, with the pitch B1 falling in the above range of 0.5 times and 1.5 times the pitch A1, the first reverse helical blade 226 both pushes back the developer directed from the first passage 205A to the developer discharge pipe 207 and functions to generate an airflow directed from the developer discharge pipe 207 to the first passage 205A in the gap between the first reverse helical blade 226 and the inner wall of the first passage 205A. As a result, discharge of airborne developer from the developer container 205 can be reduced. In some examples, the end 225 includes a portion of the first helical blade 224 corresponding to 0.5 turns of the first helical blade 224. However, in other examples, the end 225 of the first helical blade 224 may correspond to 0.25 turns or more of the first helical blade 224. Still further, the end 225 may correspond to 0.5 turns or more of the first helical blade 224. In some examples, the end 225 of the first helical blade 224 may be a portion corresponding to 1.5 turns or less of the first helical blade 224, or may correspond to 1.0 turn or less of the first helical blade 224.

Figure 8:
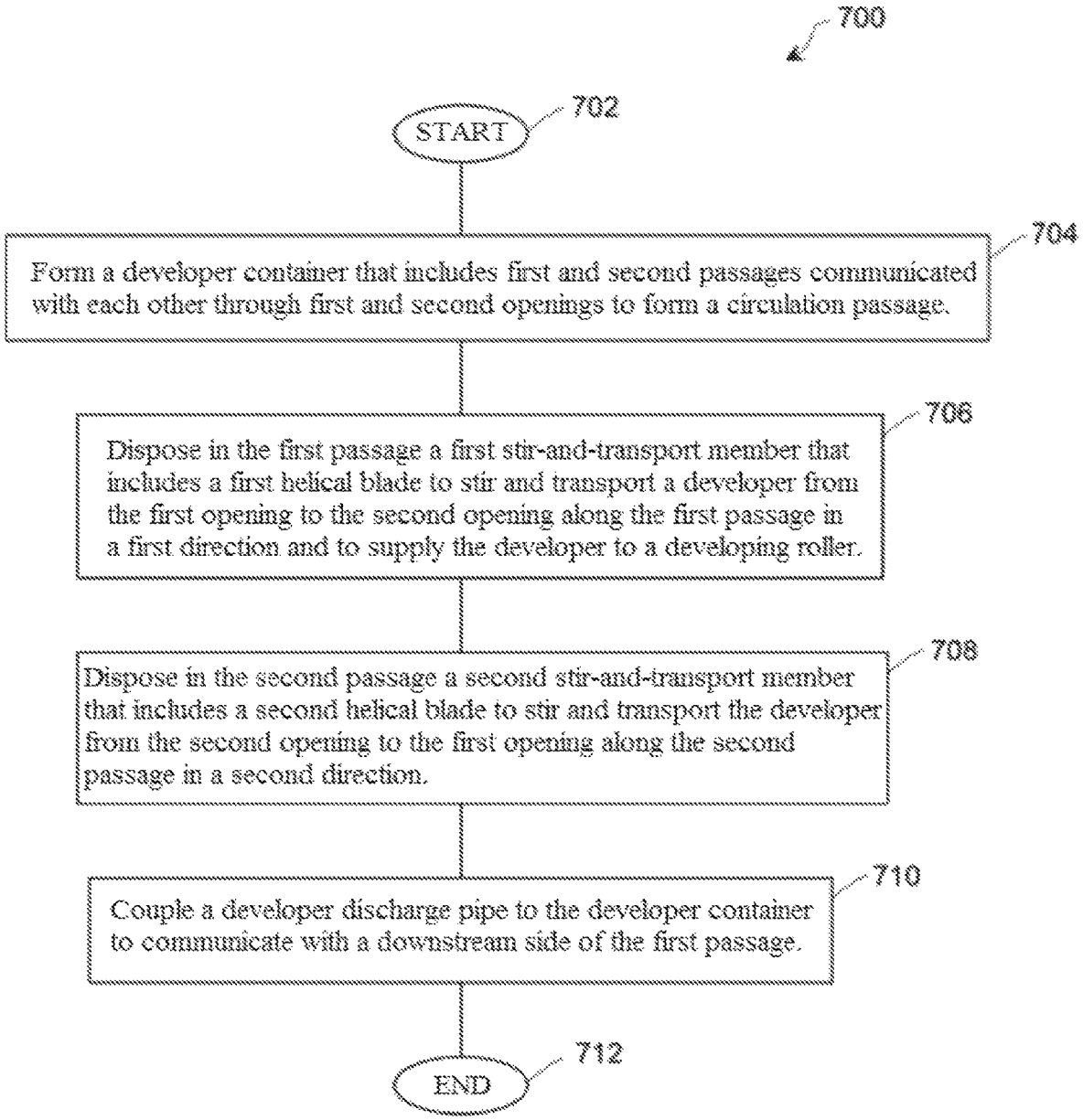
FIG. 8 is a flow diagram illustrating an example method for manufacturing a developing device.

FIG. 8 is a flow diagram illustrating an example manufacturing method 700 for a developing device starting at operation 702. At operation 704, a developer container that includes first and second passages coupled to or in communication with each other through first and second openings to form a circulation passage is formed. At operation 706, a first stir-and-transport member is disposed in the first passage. The first stir-and-transport member includes a first helical blade to stir and transport a developer from the first opening to the second opening along the first passage in a first direction and to supply the developer to a developing roller. At operation 708, a second stir-and-transport member is disposed in the second passage. The second stir-and-transport member includes a second helical blade to stir and transport the developer from the second opening to the first opening along the second passage in a second direction. At operation 710, a developer discharge pipe is coupled to the developer container to communicate with a downstream side of the first passage. The manufacturing method 700 then ends at 712. In some examples, the first stir-and-transport member may further include a first reverse helical blade formed or otherwise located downstream of the first helical blade and disposed downstream of the second opening. Additionally, the pitch of the first reverse helical blade may be between approximately 0.5 times and 1.5 times the pitch of the first helical blade at an end facing the first reverse helical blade.

In some examples, the first reverse helical blade may comprise two or more reverse helical blades. Additionally, the first reverse helical blade may comprise one reverse helical blade. A magnet may be disposed or otherwise located on an inner wall of the first passage facing the first reverse helical blade. In some examples, the magnet may be a one-sided multipole magnetized magnet. Additionally, the pitch of the first helical blade at an end facing the first reverse helical blade may be narrower than the pitch of the remaining portion of the first helical blade, and the pitch of the first reverse helical blade may be between approximately 0.5 times and 1.5 times the pitch of the first helical blade at an end facing the first reverse helical blade. The manufacturing method 700 may further include disposing a filter in the developer container to provide a means for pressurized air to escape from the developer container to the outside.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. A device to develop an electrostatic latent image in an imaging apparatus, the device comprising:

a developer container including first and second passages coupled to each other through first and second openings to form a circulation passage;

a first stir-and-transport member located in the first passage and including a first helical blade to stir and transport a developer from the first opening to the second opening along the first passage in a first direction and to supply the developer to a developing roller;

a second stir-and-transport member located in the second passage and including a second helical blade to stir and transport the developer from the second opening to the first opening along the second passage in a second direction; and a developer discharge pipe coupled to the developer container to communicate with a downstream side of the first passage, wherein the first stir-and-transport member includes a first reverse helical blade located downstream of the first helical blade and located downstream of the second opening, the first reverse helical blade comprising two or more reverse helical blades, and wherein the pitch of the first reverse helical blade is between approximately 0.5 times and 1.5 times the pitch of the first helical blade, the pitch being a distance between adjacent spirals of a particular one of the two or more reverse helical blades in a direction of an axis of rotation.

2. The device according to claim 1, wherein the pitch of the first helical blade at an end facing the first reverse helical blade is narrower than the pitch of the remaining portion of the first helical blade, and wherein the pitch of the first reverse helical blade is between approximately 0.5 times and 1.5 times the pitch of the first helical blade at the end facing the first reverse helical blade.

3. The device according to claim 1, wherein the developer discharge pipe has a developer outlet spaced from an end of the developer discharge pipe, and wherein the first stir-and-transport member includes:

a third helical blade located adjacent to the first reverse helical blade on the opposite side of the first helical blade and located in the developer discharge pipe to transport the developer that has flown from the first passage into the developer discharge pipe toward the developer outlet, and a second reverse helical blade located adjacent to a downstream side of the third helical blade and located downstream of the developer outlet.

4. The device according to claim 1, wherein the developer container includes a filter as a means for pressurized air to escape from the developer container to the outside.

5. An imaging apparatus comprising the device according to claim 1.

6. The device according to claim 1, comprising a magnet disposed on an inner wall of the first passage facing the first reverse helical blade.

7. The device according to claim 6, wherein the magnet comprises a one-sided multipole magnetized magnet.

8. The device according to claim 6, wherein the magnet includes N and S poles alternately arranged along a longitudinal direction of the first stir-and-transport member.

9. The device according to claim 6, wherein the magnet is disposed on at least 50% of a gravitationally upper side of the inner periphery of the inner wall of the first passage facing the first reverse helical blade and 20% or less of a gravitationally lower side of the inner periphery of the inner wall of the first passage facing the first reverse helical blade.

10. A method of manufacturing a developing device, the method comprising:

forming a developer container that includes first and second passages coupled to each other through first and second openings to form a circulation passage;

disposing in the first passage a first stir-and-transport member that includes a first helical blade to stir and transport a developer from the first opening to the second opening along the first passage in a first direction and to supply the developer to a developing roller;

disposing in the second passage a second stir-and-transport member that includes a second helical blade to stir and transport the developer from the second opening to the first opening along the second passage in a second direction; and coupling a developer discharge pipe to the developer container to communicate with a downstream side of the first passage, wherein the first stir-and-transport member includes a first reverse helical blade located downstream of the first helical blade and disposed downstream of the second opening, the first reverse helical blade comprising two or more reverse helical blades, and wherein the pitch of the first reverse helical blade is between approximately 0.5 times and 1.5 times the pitch of the first helical blade, the pitch being a distance between adjacent spirals of a particular one of the two or more reverse helical blades in a direction of an axis of rotation.

11. The method according to claim 10, wherein the pitch of the first helical blade at an end facing the first reverse helical blade is narrower than a pitch of a remaining portion of the first helical blade, and wherein the pitch of the first reverse helical blade is between approximately 0.5 times and 1.5 times the pitch of the first helical blade at the end facing the first reverse helical blade.

12. The method according to claim 10, comprising disposing in the developer container a filter for pressurized air to escape from the developer container to the outside.

13. The method according to claim 10, comprising disposing a magnet on an inner wall of the first passage facing the first reverse helical blade.

14. The method according to claim 13, wherein the magnet comprises a one-sided multipole magnetized magnet.

15. The method according to claim 13, wherein the magnet is disposed on at least 50% of a gravitationally upper side of the inner periphery of the inner wall of the first passage facing the first reverse helical blade and 20% or less of a gravitationally lower side of the inner periphery of the inner wall of the first passage facing the first reverse helical blade.

* * * * *